US011698175B2

(12) United States Patent
Vogelauer et al.

(10) Patent No.: US 11,698,175 B2
(45) Date of Patent: Jul. 11, 2023

(54) LIGHTING DEVICE FOR A MOTOR VEHICLE HEADLIGHT

(71) Applicant: ZKW Group GmbH, Wieselburg (AT)

(72) Inventors: Philipp Vogelauer, Randegg (AT); Jakob Pühringer, Ybbs (AT)

(73) Assignee: ZKW Group GmbH, Wieselburg (AT)

( * ) Notice: Subject to any disclaimer, the term of this patent is extended or adjusted under 35 U.S.C. 154(b) by 87 days.

(21) Appl. No.: 17/605,153

(22) PCT Filed: Mar. 17, 2021

(86) PCT No.: PCT/EP2021/056849
§ 371 (c)(1),
(2) Date: Oct. 20, 2021

(87) PCT Pub. No.: WO2021/209220
PCT Pub. Date: Oct. 21, 2021

(65) Prior Publication Data

US 2022/0307665 A1 Sep. 29, 2022

(30) Foreign Application Priority Data

Apr. 14, 2020 (EP) ..... 20169377

(51) Int. Cl.
*F21S 41/141* (2018.01)
*F21S 41/24* (2018.01)
(Continued)

(52) U.S. Cl.
CPC ..... *F21S 41/141* (2018.01); *F21S 41/24* (2018.01); *F21S 41/255* (2018.01);
(Continued)

(58) Field of Classification Search
CPC ..... F21S 41/141; F21S 41/24; F21S 41/255; F21S 41/285; F21S 45/48; F21S 41/25; F21S 41/143; B60Q 1/0041
See application file for complete search history.

(56) References Cited

U.S. PATENT DOCUMENTS 10,247,380 B2 * 4/2019 Hager ..... F21S 41/148
2014/0321141 A1 10/2014 Bauer et al.
(Continued)

FOREIGN PATENT DOCUMENTS

DE 102015224745 A1 6/2017
JP 2016039020 A 3/2016

OTHER PUBLICATIONS

International Search Report for PCT/EP2021/056849, dated Jun. 7, 2021 (13 pages).
(Continued)

*Primary Examiner* — Matthew J. Peerce
(74) *Attorney, Agent, or Firm* — Eversheds Sutherland (US) LLP

(57) ABSTRACT

A lighting device (10) for a motor vehicle headlight, comprising:
a first light module (100) for generating a low beam distribution,
a second light module (200) for generating a high beam distribution having a light-guiding body (220), in which light-guiding body (220) light can be irradiated via a coupling surface (221) and can be decoupled via a decoupling surface (222),
the light-guiding body (220) having a first reflective surface (223*a*) on a roof side (223), and
a projection lens (500) that is configured to image the light that can be generated by the first and second light modules (100, 200) in front of the lighting device (10),
(Continued)

the light-guiding body (220) being designed in such a way that an aperture for part of the light that can be generated by the first light module (100) is arranged between the first light module (100) and the projection lens (500), the lighting device (10) comprising a third light module (300) for generating an additional light distribution, and the light-guiding body (220) having a bottom surface (224) that has a second reflective surface (224*a*), the third light module (300) being arranged in such a way that part of the light can be reflected from the second reflective surface (224*a*).

16 Claims, 2 Drawing Sheets

(51) Int. Cl.
*F21S 41/255* (2018.01)
*F21S 41/20* (2018.01)
*F21S 45/48* (2018.01)
*F21Y 115/10* (2016.01)
*F21W 102/13* (2018.01)

(52) U.S. Cl.
CPC ..... *F21S 41/285* (2018.01); *F21S 45/48* (2018.01); *F21W 2102/13* (2018.01); *F21Y 2115/10* (2016.08)

(56) References Cited

U.S. PATENT DOCUMENTS

| | | | |
|---|---|---|---|
| 2016/0040848 | A1 | 2/2016 | Tsukamoto |
| 2017/0136939 | A1 | 5/2017 | Mouri et al. |
| 2017/0299137 | A1 | 10/2017 | Kinoshita et al. |
| 2017/0350568 | A1 | 12/2017 | Hager et al. |
| 2019/0145595 | A1 | 5/2019 | Takada et al. |

OTHER PUBLICATIONS

Search Report for European Patent Application No. 20169377.7 dated Oct. 28, 2020 (8 pages).

* cited by examiner

LIGHTING DEVICE FOR A MOTOR VEHICLE HEADLIGHT

The invention relates to a lighting device for a motor vehicle headlight, comprising:

at least one first light module having at least one light source for generating a low beam distribution in the direction of a main beam direction, at least one second light module for generating a high beam distribution, the second light module comprising at least one light source and a light-guiding body, in which light guide body light from the light source can be irradiated via a coupling surface into the light-guiding body and can be decoupled via a decoupling surface in the direction of the main beam direction, the light-guiding body having a first reflective surface on a roof side extending from the coupling surface to the decoupling surface and the light guide body being arranged relative to the first light module in such a way that at least part of the decoupled light that can be generated by the first light module can be reflected on the first reflective surface, and at least one projection lens that is configured to image the light that can be generated by the first and second light module in front of the lighting device, the light-guiding body being designed in such a way that an aperture for part of the light that can be generated by the first light module for generating the low beam distribution is arranged between the first light module and the projection optics.

The invention further relates to a motor vehicle headlight having at least one lighting device according to the invention.

Usually, a plurality of lighting devices are installed in motor vehicle headlights, each of which is provided for low beam distribution, high beam distribution and additional light distribution, such as sign light distribution. Because these three lighting devices are available spatially separated from one another and are also installed separately, an enormous amount of installation space is required in a motor vehicle headlight.

Lighting devices are known from the prior art that can implement both a low beam distribution and a high beam distribution, but no further additional light distribution.

It is an object of the invention to provide an improved lighting device.

This object is achieved in that the lighting device comprises at least one third light module having a light source for generating an additional light distribution, the light-guiding body of the second light module having a bottom surface facing away from the roof surface, which bottom surface has a second reflective surface at least in portions, the third light module being arranged in such a way that at least part of the decoupled light that can be generated by the third light module can be reflected by the bottom surface of the light-guiding body, and the projection lens being configured to image the light that can be generated by the third light module in front of the lighting device.

To implement the additional light distribution, an additional lighting device that is spatially separate from the lighting device is usually provided. With a lighting device according to the invention, lighting devices having a design that is as space-saving as possible can be implemented because structures that are already present are used in the lighting device in order to allow additional light distribution.

In general, the assignment of the terms with regard to a location or an orientation, such as "horizontal," "vertical," "in the horizontal direction," "in the vertical direction," "above," "below," "in front," "rear," "below," "above," etc. are chosen only for the sake of simplicity below, and these terms relate to the representation in the drawings as well as to a lighting device properly installed in a motor vehicle headlight that is installed in a motor vehicle.

It can be provided that the roof surface and the decoupling surface of the light-guiding body form an aperture edge in a common surface intersection line.

It can be provided that the aperture edge has a contour to form a light-dark boundary of the low beam distribution.

It can be provided that the bottom surface and the decoupling surface of the light-guiding body form a lower edge in a common surface intersection line.

It can be provided that the second reflective surface ends at a distance from the lower edge and releases a coupling region on the underside into which part of the light from the third light module can be coupled and decoupled again via the decoupling surface of the light-guiding body.

It can be provided that the first reflective surface ends at a distance from the aperture edge and releases a decoupling region on the upper side from which part of the light of the third light module, which can be coupled via the coupling region on the underside, can be decoupled.

It can be provided that the light sources of the light modules are each designed as at least one light-emitting diode.

It can be provided that the lighting device comprises a carrier body on which the light sources of the light modules are arranged.

It can be provided that the carrier body is designed as a heat sink, said heat sink preferably comprising cooling fins.

It can be provided that the carrier body comprises a third reflective surface that is arranged opposite the bottom surface of the light-guiding body, and the third reflective surface being configured to reflect part of the light that can be generated by the third light module.

It can be provided that the projection lens has a first optical axis and a first focal surface corresponding to the first optical axis.

The "optical axis" is the axis of symmetry of a rotationally symmetrical optical system or a projection lens. In this case, the important aspect is the symmetry of the surfaces, not the boundaries thereof. Likewise, sections of an otherwise non-symmetrical lens can also have rotationally symmetrical portions to which an imaginary optical axis can be assigned.

It can be provided that the projection lens has a second optical axis and a second focal surface corresponding to the second optical axis.

It can be provided that the aperture edge of the light-guiding body, preferably the decoupling surface of the light-guiding body, is arranged in the focal surface, the first optical axis of the projection lens preferably intersecting the aperture edge of the light-guiding body.

It can be provided that the second optical axis of the projection lens is arranged in the vertical direction below the light-guiding body.

The object is also achieved by a motor vehicle headlight having at least one lighting device according to the invention.

The invention will be explained in more detail below with reference to exemplary drawings. In the drawings.

Figure 1:
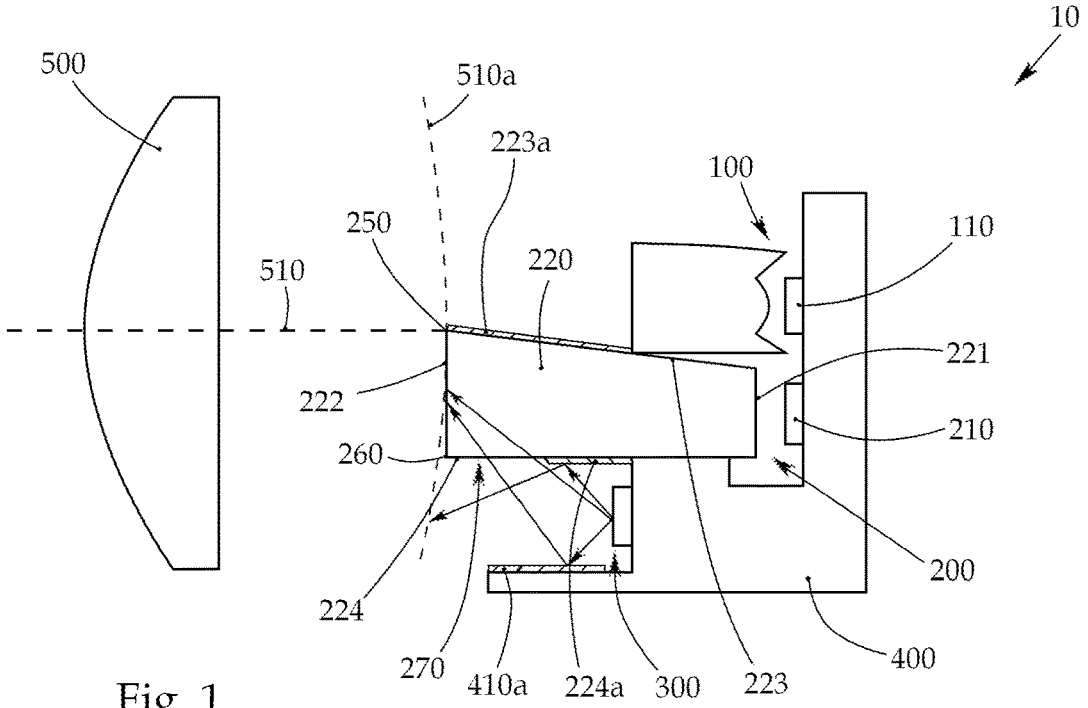
FIG. 1 shows an exemplary lighting device in a side view.

FIG. 1 shows an exemplary lighting device 10 for a motor vehicle headlight, comprising a first light module 100 having a light source 110 for generating a low beam distribution in the direction of a main beam direction, a second light module 200 for generating a high beam distribution, the second light module 200 comprising a light source 210 and a light-guiding body 220, in which light guide body 220 light from the light source 210 can be irradiated via a coupling surface 221 into the light-guiding body 220 and can be decoupled via a decoupling surface 222 in the direction of the main beam direction.

The light-guiding body 220 has a first reflective surface 223*a* on a roof side 223 extending from the coupling surface 221 to the decoupling surface 222, the light-guiding body 220 being arranged relative to the first light module 100 in such a way that at least part of the decoupled light that can be generated by the first light module 100 can be reflected on the first reflective surface 223*a*.

Furthermore, the lighting device 10 comprises a projection lens 500 that is configured to image the light that can be generated by the first and second light modules 100, 200 in front of the lighting device 10, the light-guiding body 220 being designed in such a way that an aperture for part of the light that can be generated by the first light module 100 for generating the low beam distribution is arranged between the first light module 100 and the projection lens 500.

For this purpose, the roof surface 223 and the decoupling surface 222 of the light-guiding body 220 form an aperture edge 250 in a common surface intersection line, the aperture edge 250 having a contour to form an asymmetrical light-dark boundary typical for the low beam distribution.

The projection lens 500 has a first optical axis 510 and a first focal surface 510*a* corresponding to the first optical axis 510, the aperture edge 250 of the light-guiding body 220, preferably the decoupling surface 222 of the light-guiding body 220, being arranged in the first focal surface 510*a*, the first optical axis 510 of the projection lens 500 preferably intersecting the aperture edge 250 of the light-guiding body 220.

The lighting device 10 further comprises a third light module 100 having a light source for generating additional light distribution, the light-guiding body 220 of the second light module 200 having a bottom surface 224 facing away from the roof surface 223, which bottom surface has a second reflective surface 224*a* at least in portions.

The third light module 100 is arranged in such a way that at least part of the decoupled light that can be generated by the third light module 300 can be or is reflected by the second reflective surface 224*a* of the light-guiding body 220 and is substantially deflected in the direction of the main beam direction or in the direction of the projection lens 500. For this purpose, the projection lens 500 is also configured to image the light that can be generated by the third light module 300 in front of the lighting device 10.

Furthermore, the bottom surface 224 and the decoupling surface 222 of the light-guiding body 220 form a lower edge 260 in a common surface intersection line, the second reflective surface 224*a*, in the example shown in FIG. 1, ending at a distance from the lower edge 260 and releasing a coupling region 270 on the underside into which part of the light from the third light module 300 can be coupled and can be decoupled again via the decoupling surface 222 of the light-guiding body 220.

In addition, the lighting device 10 comprises a carrier body 400 on which the light sources of the light modules 100, 200, 300 are arranged, it being possible for the light sources to be designed as at least one light-emitting diode. For this purpose, it can be provided that the carrier body 400 is designed as a heat sink in order to dissipate the heat that can be generated by the light sources during operation.

In the examples shown, the carrier body 400 comprises a third reflective surface 410*a* that is arranged opposite the bottom surface 224 of the light-guiding body 220, and the third reflective surface 410*a* being configured to reflect part of the light that can be generated by the third light module 300.

Figure 2:
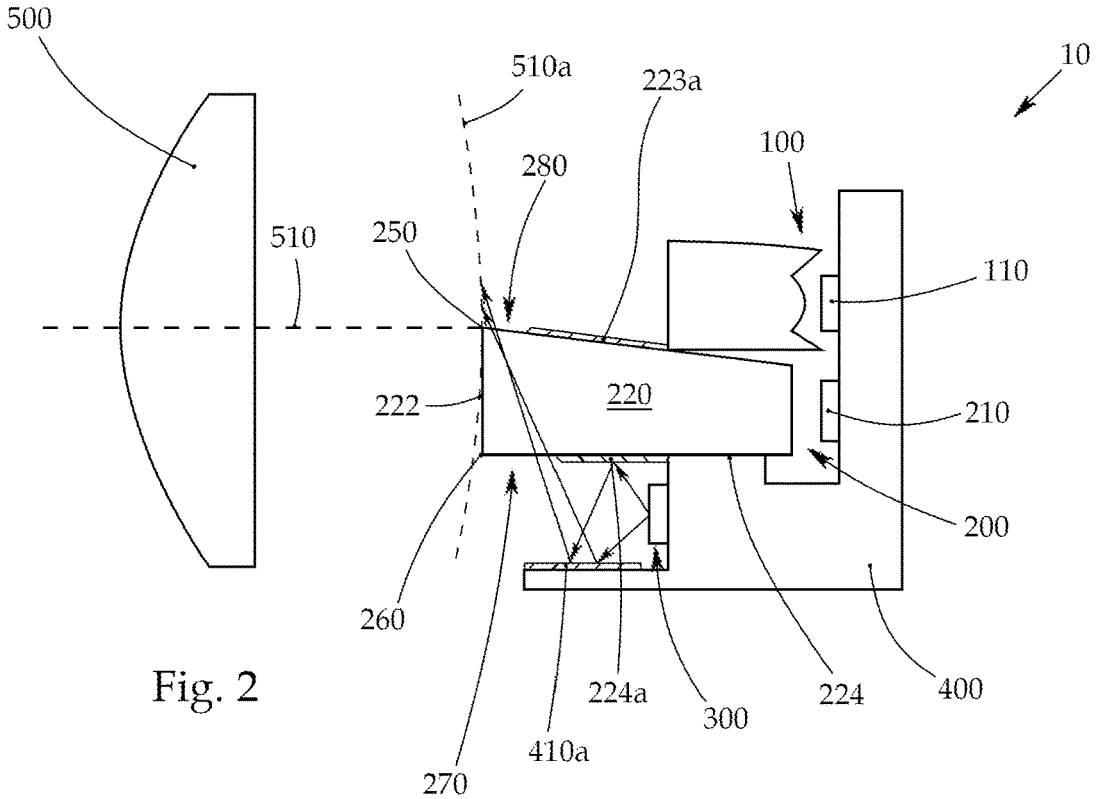
FIG. 2 shows a further exemplary lighting device in a side view.

In FIG. 2, the example from FIG. 1 is substantially shown, whereas the first reflective surface 223*a* ends at a distance from the aperture edge 250 and releases a decoupling region 280 on the upper side from which part of the light of the third light module 300, which can be coupled via the coupling region 270 on the underside, can be decoupled. The light that can be decoupled through the decoupling region 280 on the upper side hits a region of the first focal surface 510*a*, which region is located above the first optical axis 510 in the case of a properly installed lighting device in a motor vehicle headlight and imaged in the light distribution imaged in front of the lighting device 10, i.e. close to the lighting device on a roadway.

The embodiment in FIG. 1, on the other hand, does not have a decoupling region on the upper side, as a result of which the light of the third light module 300 that can be decoupled through the decoupling surface 222 hits a region of the first focal surface 510*a*, which region is located below the first optical axis 510 in the case of a properly installed lighting device in a motor vehicle headlight and imaged in the light distribution imaged in front of the lighting device 10, for example as a sign light distribution.

Figure 3:
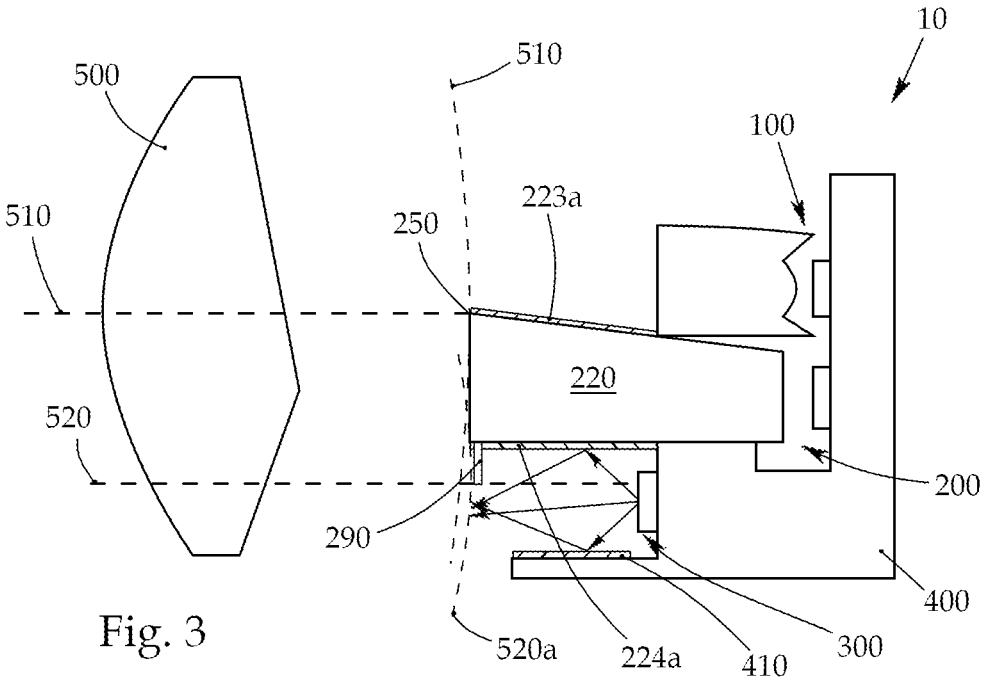
FIG. 3 shows a further example of a lighting device in a side view.

FIG. 3 is similar to the examples in FIGS. 1 and 2, the projection lens 500 being designed as a bifocal projection lens having a second optical axis 520 and a second focal surface 520*a* corresponding to the second optical axis 520, and the second optical axis 520 of the projection lens 500 being arranged in the vertical direction below the light-guiding body 220. As a result, light emitted from the third light module 300, which is also deflected by the second and third reflective surfaces, hits a region below the second optical axis 520. In order to intensify the effect, a further aperture 290 is provided, which extends in the vertical direction and shades light that would hit a region above the second optical axis 520.

Figure 4:
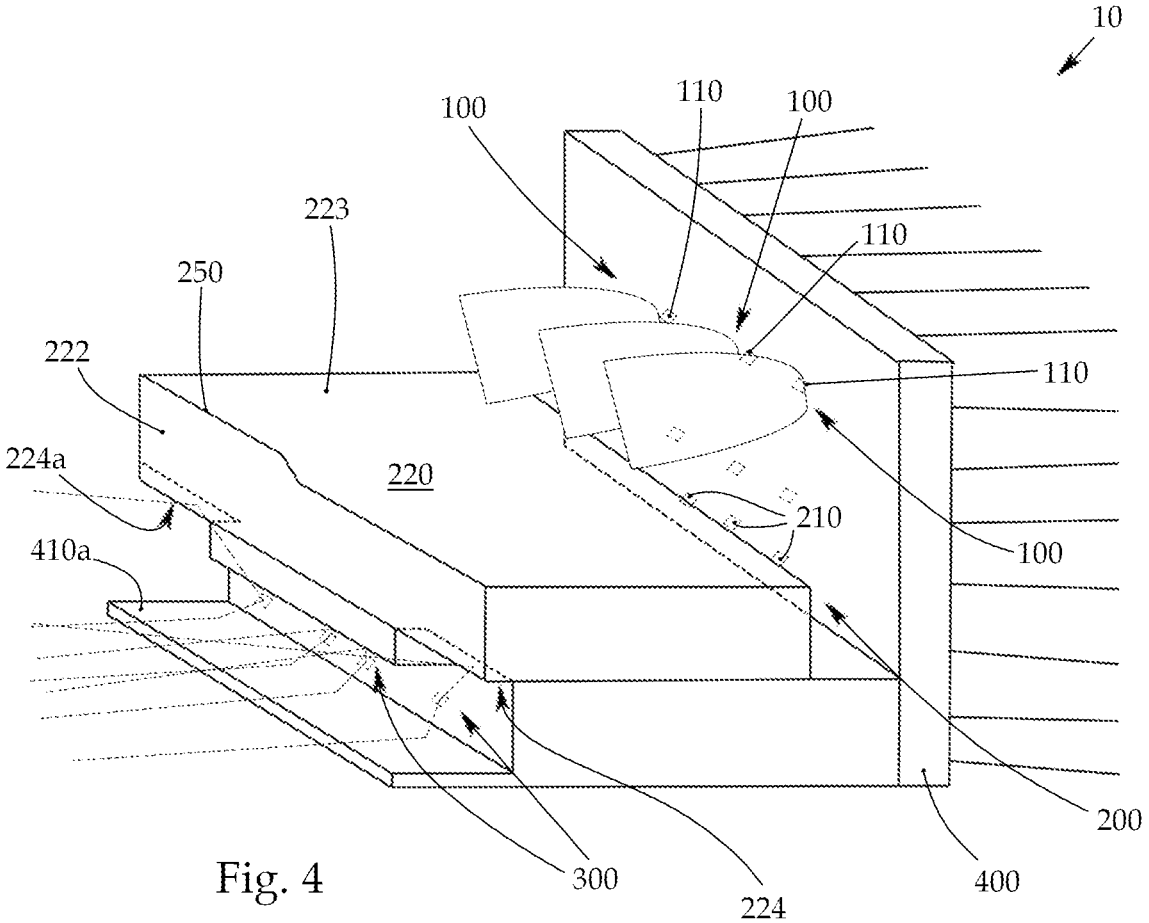
FIG. 4 shows a further example of a lighting device in a perspective view.

FIG. 4 shows a further embodiment, what has been said above substantially also applying to this example, a projection lens also being included that is not, however, shown in FIG. 4. In this case, the second reflective surface is divided into two separate partial regions, the region separating the two parts being part of the light-guiding body 220. With this embodiment, the high beam distribution imaged in front of the lighting device 10 can be widened in the horizontal direction.

The invention claimed is:

1. A lighting device (10) for a motor vehicle headlight, comprising:

at least one first light module (100) having at least one light source (110) for generating a low beam distribution in the direction of a main beam direction, at least one second light module (200) for generating a high beam distribution, the second light module (200) comprising at least one light source (210) and a light-guiding body (220), in which light guide body (220)

light from the light source (210) can be irradiated via a coupling surface (221) into the light-guiding body (220) and can be decoupled via a decoupling surface (222) in the direction of the main beam direction, the light-guiding body (220) having a first reflective surface (223*a*) on a roof side (223) extending from the coupling surface (221) to the decoupling surface (222) and the light guide body (220) being arranged relative to the first light module (100) in such a way that at least part of the decoupled light that can be generated by the first light module (100) can be reflected on the first reflective surface (223*a*), and at least one projection lens (500) that is configured to image the light that can be generated by the first and second light module (100, 200) in front of the lighting device (10), the light-guiding body (220) being designed in such a way that an aperture for part of the light that can be generated by the first light module (100) for generating the low beam distribution is arranged between the first light module (100) and the projection lens (500), wherein the lighting device (10) comprises at least one third light module (300) having a light source for generating additional light distribution, and the light-guiding body (220) of the second light module (200) having a bottom surface (224) facing away from the roof surface (223), which bottom surface has a second reflective surface (224*a*) at least in portions, the third light module (300) being arranged in such a way that at least part of the decoupled light that can be generated by the third light module (300) can be reflected by the second reflective surface (224*a*) of the light-guiding body (220), and the projection lens (500) being configured to image the light that can be generated by the third light module (300) in front of the lighting device (10), wherein the bottom surface (224) and the decoupling surface (222) of the light-guiding body (220) form a lower edge (260) in a common surface intersection line, and wherein the second reflective surface (224*a*) ends at a distance from the lower edge (260) and releases a coupling region (270) on the underside into which part of the light from the third light module (300) can be coupled and can be decoupled again via the decoupling surface (222) of the light-guiding body (220).

2. The lighting device according to claim 1, wherein the roof surface (223) and the decoupling surface (222) of the light-guiding body (220) form an aperture edge (250) in a common surface intersection line.

3. The lighting device according to claim 2, wherein the aperture edge (250) has a contour to form a light-dark boundary of the low beam distribution.

4. The lighting device according to claim 1, wherein the first reflective surface (223*a*) ends at a distance from the aperture edge (250) and releases a decoupling region (280) on the upper side from which part of the light of the third light module (300), which can be coupled via the coupling region (270) on the underside, can be decoupled.

5. The lighting device according to claim 1, wherein the light sources of the light modules (100, 200, 300) are each designed as at least one light-emitting diode.

6. The lighting device according to claim 1, wherein the lighting device (10) comprises a carrier body (400) on which the light sources of the light modules (100, 200, 300) are arranged.

7. The lighting device according to claim 6, wherein the carrier body (400) is designed as a heat sink.

8. The lighting device according to claim 7, wherein the carrier body (400) comprises cooling fins.

9. The lighting device according to claim 6 wherein the carrier body (400) comprises a third reflective surface (410*a*) that is arranged opposite the bottom surface (224) of the light-guiding body (220), and the third reflective surface (410*a*) being configured to reflect part of the light that can be generated by the third light module (300).

10. The lighting device according to claim 1, wherein the projection lens (500) has a first optical axis (510) and a first focal surface (510*a*) corresponding to the first optical axis (510).

11. The lighting device according to claim 10, wherein the projection lens (500) has a second optical axis (520) and a second focal surface (520*a*) corresponding to the second optical axis (520).

12. The lighting device according to claim 10, wherein the aperture edge (250) of the light-guiding body (220); is arranged in the first focal surface (510*a*).

13. The lighting device according to claim 12 wherein the second optical axis (520) of the projection lens (500) is arranged in the vertical direction below the light-guiding body (220).

14. The lighting device according to claim 12, wherein the aperture edge (250) of the decoupling surface (222) of the light-guiding body (220) is arranged in the first focal surface (510*a*).

15. The lighting device according to claim 12, wherein the first optical axis (510) of the projection lens (500) intersects the aperture edge (250) of the light-guiding body (220).

16. A motor vehicle headlight having at least one lighting device (10) according to claim 1.

* * * * *